US005611284A

United States Patent [19]

Smith et al.

[11] Patent Number: 5,611,284

[45] Date of Patent: Mar. 18, 1997

[54] RAIL TRUCK SUSPENSION AND JOURNAL HOUSING RETENTION ASSEMBLY

[75] Inventors: Sam D. Smith, Effingham; Michael A. Peitsch, Atchison, both of Kans.; Richard D. Curtis, Munster, Ind.

[73] Assignee: Atchison Casting Corporation, Atchison, Kans.

[21] Appl. No.: 588,043

[22] Filed: Jan. 19, 1996

[51] Int. Cl.[6] ..... B61F 5/30

[52] U.S. Cl. ..... 105/220; 105/218.1; 105/224.05; 105/224.1

[58] Field of Search ..... 105/217, 218.1, 105/220, 221.1, 224.05, 224.06, 224.1

[56] References Cited

U.S. PATENT DOCUMENTS

| | | | |
|---|---|---|---|
| 1,377,708 | 5/1921 | Lamont | 105/224.05 |
| 2,286,563 | 6/1942 | Mussey | 105/224.1 |
| 4,674,413 | 6/1987 | Eggert, Jr. | 105/224.05 |
| 4,932,330 | 6/1990 | Herring, Jr. | 105/220 |
| 5,107,773 | 4/1992 | Daley et al. | 105/218.1 |
| 5,456,187 | 10/1995 | Polley | 105/218.1 |

FOREIGN PATENT DOCUMENTS

| | | | |
|---|---|---|---|
| 2518948 | 7/1983 | France | 105/224.1 |

*Primary Examiner*—S. Joseph Morano
*Attorney, Agent, or Firm*—Hovey, Williams, Timmons & Collins

[57] ABSTRACT

A railtruck apparatus is provided for supporting a railcar body on two longitudinally spaced wheel and axle sets. The railtruck includes a frame having two side frame members, each defining a pair of longitudinally spaced cradles. A bearing housing is received in each cradle and includes a top wall, two longitudinally spaced side walls depending from the top wall, and an open bottom sized for receipt over a journal bearing of one of the wheel and axle sets. A removable bottom cap closes off each bearing housing to permit assembly and disassembly of the wheel and axle sets. A primary suspension is positioned between each bearing housing and the frame for supporting the frame on the bearing housing, and is retained in position on the frame when the frame is raised relative to the bearing housing. Thus, when the wheel and axle sets are removed from the apparatus, the bearing housings and the primary suspension assemblies are retained on the frame. The railtruck apparatus can also be provided with a load-equalizing spring assembly for supporting each bearing housing on one of the wheel and axle sets, the load-equalizing spring assembly being operatively interposed between the bearing housing and the wheel and axle set along the path of transmission of loads between the bearing housing and the wheel and axle set so that when the set is lowered in the bearing housing, the load exerted on the set by the frame is transmitted through the primary suspension and the load-equalizing spring assembly acting in series.

18 Claims, 6 Drawing Sheets

RAIL TRUCK SUSPENSION AND JOURNAL HOUSING RETENTION ASSEMBLY

BACKGROUND OF THE INVENTION

1. Field of the Invention

The present invention relates generally to railtrucks for use in supporting cars for movement along parallel rails or tracks, and more particularly to a railtruck suspension for supporting such railtrucks on wheel and axle sets of known construction.

2. Discussion of the Prior Art

It is known to provide an H-shaped railtruck for use in supporting a railcar on longitudinally spaced wheel and axle sets for movement along a pair of laterally spaced rails. A particular prior art construction is illustrated in U.S. Pat. No. 5,107,773, to Daley et al., and generally includes the railtruck -frame presenting four integral corner pedestals that receive wheel bearing housings within which the axles of the wheel sets are supported for rotation. A primary suspension is provided between the frame and each bearing housing for supporting the frame on the wheel and axle sets. A tie bar extends beneath each bearing housing and is fastened to the pedestal both in front of and in back of the housing for lifting the housing with the frame when the frame is raised.

Each bearing housing in the known construction forms a complete enclosure of the bearing therein, and is installed in an outboard bearing construction by sliding it horizontally over the bearing or journal after the wheels are pressed on the axle. In an inboard bearing construction of the apparatus, the bearing housing must be installed before the wheels are pressed on the axle.

The primary suspension between the frame and each bearing housing in the noted prior art construction includes front and rear elastomeric suspension members supported between the frame and the housing, wherein each member consists of a plurality of elastomeric pieces sandwiched between thin metal plates. The pieces and plates are both of chevron shape. The suspension members support the bearing housing so that upward movement of the housing produces compression of the elastomeric portions, increasing the vertical constraint that they provide and centering the vertical travel. Thus, the primary spring suspension units provide flexibility vertically, longitudinally and transversely to give control of wheel and axle set motions to reduce shock and vibration plus minimize hunting oscillations. Damping of the vertical motion can be provided by dampers connected between the housings and the frame.

Each of the suspension members in the prior art construction are mounted on the frame by an L-shaped intermediate mounting member having a long vertical portion presenting a vertical surface that mates with a corresponding vertical surface of the associated pedestal, and a short horizontal portion presenting an upper horizontal surface that bears against a lower horizontal face of the pedestal. The long vertical portion is tapered, presenting a wedge shape in side elevation, and presents a support surface opposite the vertical surface for supporting one of the suspension members. Retainers are provided for holding the intermediate mounting members in place on the pedestals, and extend through the tie bars and the short horizontal portions of the members. If it is necessary to adjust the vertical position of a bearing housing in its pedestal, e.g. because of wheel tread wear, this can be done by placing horizontal shims of the necessary thickness between the upper surfaces of the intermediate members and the lower horizontal surfaces of the pedestal that are associated with the housing.

In order to remove an axle from the railtruck of the known construction, it is necessary to first remove the tie bars from the two pedestals supporting the axle, and to raise the frame above the primary suspension members so that the chevron suspension members and the L-shaped intermediate mounting members fall to the ground. Thereafter, if the construction is an outboard bearing type, the axle can be rolled out and one or both of the bearing housings can be removed from the axle. Reassembly of the axle follows these steps in reverse, requiring that the suspension members and the intermediate mounting members be held in place by hand until the frame is lowered, loading the suspension members. Thus, several workers must cooperate to assemble the axle on the railtruck, and a relatively long time is required to complete the operation.

Shimming for wheel wear in the known construction is also relatively complicated, requiring again that the tie bar be removed from the pedestal at which shims are to be installed. Thereafter, the frame is raised to remove the load from the primary suspension members and produce a space for the shims. However, the frame must not be lifted too far or the suspension members will fall to the ground. Once a space is provided between the horizontal surfaces of the intermediate mounting members and the pedestal, shims are inserted and the frame is lowered to load the suspension members. The tie bars are then fastened in place to complete the operation.

The noted prior art construction does not allow for shimming to compensate for machining variations. Therefore, very tight tolerances must be maintained during machining, and non-conforming results must be welded and re-machined, adding to the cost of manufacture of the railtrucks. In addition, there is no provision for shimming for settlement of the chevron suspension members or for axle tram independent of machining tram. Thus, the construction does not permit the necessary adaptability to enable long use of the component parts thereof.

During the development of an improved railtruck apparatus, the inventors were made aware of new requirements that were being considered by regulators. The Amtrak High Speed Trainset Specification 558, issued on Apr. 17, 1995, states the new requirement as being 25% maximum wheel load change at 2.25" of height change at one wheel. Railtrucks having equal or less change are in compliance.

The requirement of 25% at 2.25" would effectively eliminate many types of previously considered acceptable rail passenger trucks including the prior art construction discussed above which shows about 40% wheel load change. No known type of outboard journal rigid frame railtruck with primary suspension at the journal box would comply with the new requirements. The wider frame possible with outboard journal railtrucks is sometimes preferred because it provides more space for mounting propulsion and braking equipment, and because it results in higher roll resistance which improves the ride performance. An advantage of inboard railtrucks is that they have improved wheel load-equalization characteristics due to geometry. However, even known inboard railtruck constructions would have difficulty complying with the new requirements.

There are two known types of passenger railtrucks that would comply with the noted requirements. The first is a fully equalized rigid frame truck having an added member called an equalizer beam that transmits the load from the frame to the journal box. The primary springs in this known construction are spaced closely enough to improve the wheel load equalization. The second type of passenger railtruck in compliance with the requirements is an articulated frame railtruck, of which one design has spherical ball joints or elastomer elements installed on a somewhat diagonal centerline to join two sides of the frame set, effectively forming a hinge line. This reduces the effect of raising or lowering one wheel by removing the rigidity of the frame.

OBJECTS AND SUMMARY OF THE INVENTION

It is an object of the present invention to provide a railtruck having a construction that simplifies the removal and replacement of wheel and axle sets, and that allows quick, relatively easy shimming for machining variations, suspension settlement, and wheel tread wear.

It is another object of the present invention to provide a railtruck having a construction that improves the equalization of loads on all of the wheels on which the railtruck is supported during height change of any one of the wheels, in compliance with proposed performance requirements.

In accordance with a first aspect of the invention evident from the following description of a preferred embodiment, a railtruck apparatus is provided for supporting a railcar body on two longitudinally spaced wheel and axle sets, wherein each wheel and axle set includes an axle presenting opposed ends, a pair of laterally spaced wheels secured to the axle, a pair of laterally spaced journals, and a pair of bearings supported on the journals. The apparatus includes a frame having two longitudinally extending side frame members and a transom connecting the side frame members together. Each side frame member defines a pair of longitudinally spaced cradles, each aligned longitudinally with the cradles of the other side frame member. Four bearing housings are also provided, each received in one of the cradles of the frame and including a top wall, two longitudinally spaced side walls depending from the top wall, and an open bottom having a predetermined size adapted for receipt over one of the journal bearings. A bottom cap is attached to each bearing housing between the side walls to close the open bottom upon assembly of a wheel and axle set on the apparatus. The bottom caps are removable to permit the wheel and axle sets to be removed from the apparatus. A primary suspension means is positioned between each bearing housing and the frame for supporting the frame on the bearing housing. A retention means retains each bearing housing on the frame, and retains the primary suspension means in position between the frame and the bearing housing, when the frame is raised relative to the bearing housing so that when the wheel and axle sets are removed from the apparatus, the bearing housings and the primary suspension means are retained on the frame.

By providing a railtruck apparatus in accordance with the present invention, numerous advantages are realized. For example, by providing bearing housings that are retained on the frame upon removal of the wheel and axle sets, it is not necessary to remove the primary suspension means from between the frame and the housings each time the wheel and axle sets are removed or replaced. This reduces the number of pads that must be taken off of the apparatus during such wheel and axle set replacement, and simplifies the operation so that fewer workers can complete the operation in a relatively short time.

In addition, by providing a construction in accordance with the invention, it is possible to shim for machining variations, suspension settlement, and wheel tread wear without excessive effort.

In accordance with a second aspect of the invention, a railtruck apparatus is provided which includes a frame having two longitudinally extending side frame members, and four bearing housings, each including a top wall and two longitudinally spaced side walls depending from the top wall. Each bearing housing has a central opening of predetermined size adapted for receiving one of the journal bearings and for accommodating relative vertical movement between the journal bearing and the bearing housing. A primary suspension means is positioned between each bearing housing and the frame for supporting the frame on the bearing housing, and a load-equalizing spring means supports each bearing housing on one of the journal bearings. The load-equalizing spring means is operatively interposed between the bearing housing and the journal bearing along the path of transmission of loads so that when the journal bearing is lowered in the bearing housing, the load exerted on the journal by the frame which was transmitted through the elastomeric primary suspension means is now transmitted through the load-equalizing spring means acting in series with the elastomeric means.

Numerous advantages are realized by employing such a railtruck apparatus. For example, by providing a load-equalizing spring means that supports each bearing housing on one of the journal bearings, a construction results in which the load-equalizing spring means is operatively interposed between the primary suspension means and the journal bearing so that when the journal bearing is lowered, the load is maintained on the wheel. Thus the range of movement of the bearing journal that can occur while a load is maintained on the journal by the series combination of the primary suspension means and the load-equalizing means is increased.

In addition, the various aspects of the invention can be combined in various ways to provide a single construction having many or all of the advantages discussed above, and satisfying all of the noted objects.

BRIEF DESCRIPTION OF THE DRAWING FIGURES

The preferred embodiment of the present invention is described in detail below with reference to the attached drawing figures, wherein.

DETAILED DESCRIPTION OF THE PREFERRED EMBODIMENT

Figure 1:
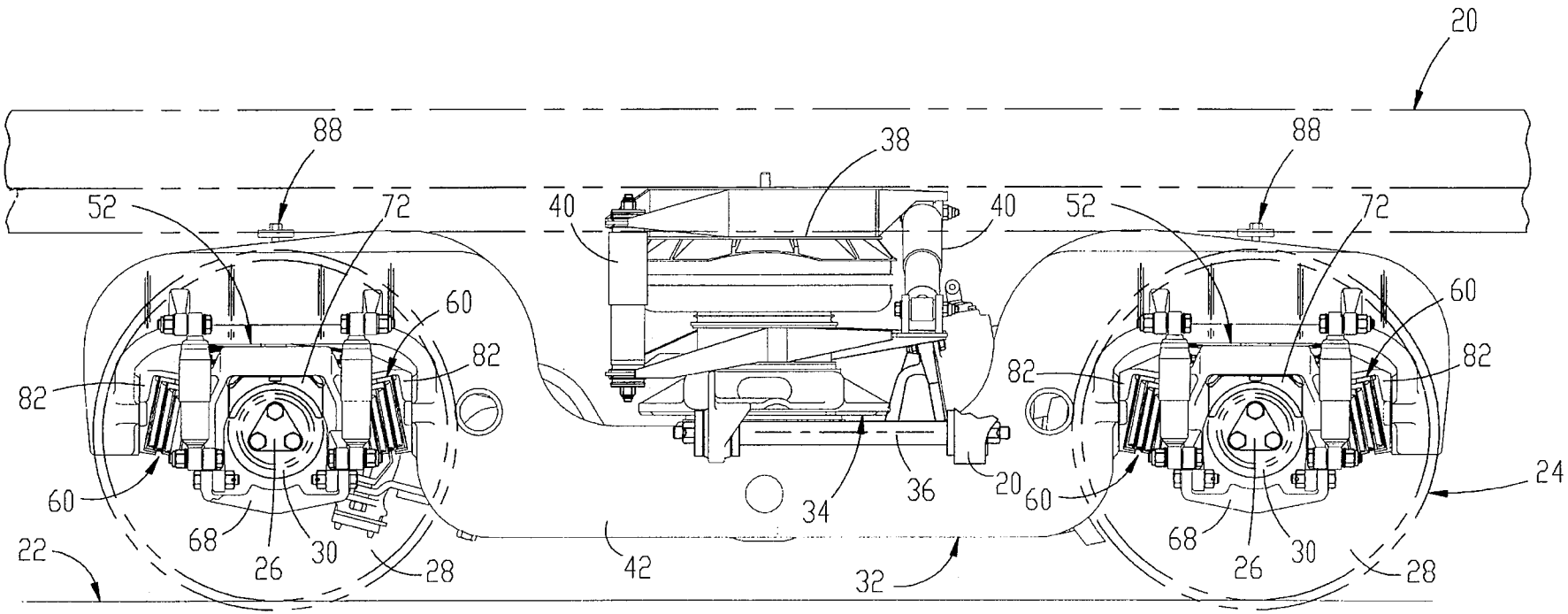
FIG. 1 is a side elevational view of a railtruck constructed in accordance with the preferred embodiment, wherein the railtruck is supported on a pair of wheel and axle sets.

A railtruck constructed in accordance with the present invention is illustrated in FIG. 1, in use with a railcar 20 supported for movement along a pair of laterally spaced rails 22. The railcar is adapted for inner city, commuter service and/or inter-city service such as Amtrak. However, the invention is not limited to these types of passenger railcars, and may also be applied to other types of railcars.

Two railtrucks are provided for supporting the railcar, and each railtruck is supported on a pair of longitudinally-spaced wheel and axle sets 24. Each wheel and axle set includes an axle 26 presenting opposed ends, a pair of laterally spaced wheels 28 secured to the axle, a pair of laterally spaced journal bearings 30 supported on the axle. Although the preferred embodiment illustrated in the drawing figures is employed on an outboard railtruck arrangement, the invention is also applicable to inboard arrangements. In an inboard construction, the journal bearings are located inboard of the wheels, i.e. on the axle between the wheels, and in an outboard construction, the journal bearings are located outboard or outside of the wheels.

Each railtruck generally includes an H-shaped frame 32, a bolster 34 supported on the frame by low-friction sidebearings, and primary suspension means for supporting the frame on a pair of the wheel and axle sets 24. The bolster 34 additionally engages the frame at a center pin which allows the frame to swivel relative to the bolster for negotiating a curve. The center pin transmits lateral and longitudinal loads which occur, e.g. as a result of curving or braking. Traction rods 36 are provided between the bolster and the railcar for transmitting braking loads from the bolster to the car body. The primary function of the bolster is to transmit loads from the railcar to the frame. The railcar is supported on the bolster by a secondary suspension 38, preferably including air springs or coil springs positioned between the railcar and the bolster. Vertical and lateral dampers 40 are also provided. The vertical load transmitted to the frame through the sidebearings, and the horizontal loads into the center pin, are transmitted by the frame into the primary suspension means.

Figure 3:
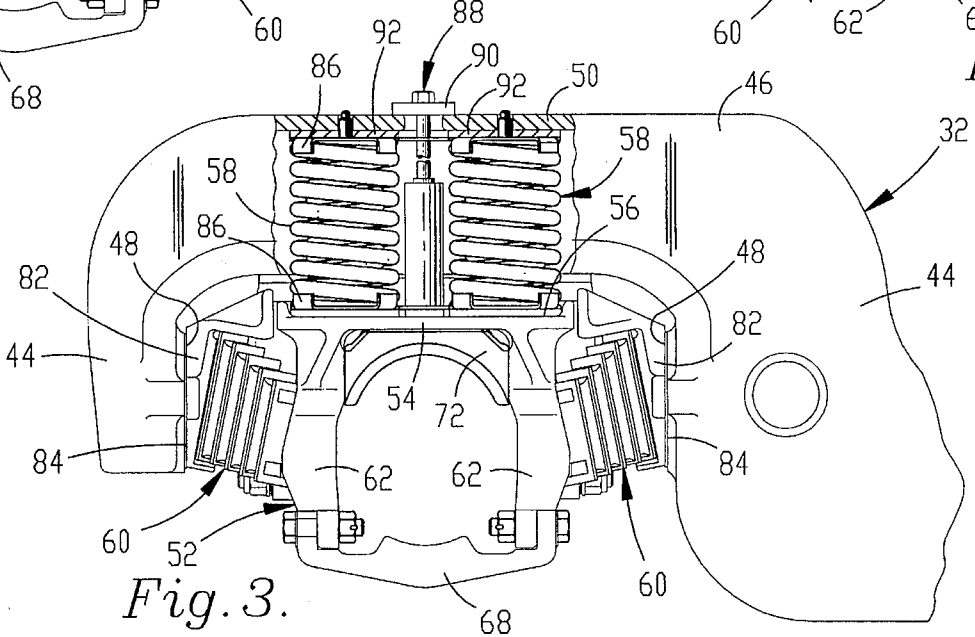
FIG. 3 is a fragmentary side elevational view of the railtruck from inside of the railtruck, partially cut away to illustrate particular features of the suspension assembly.
Figure 2:
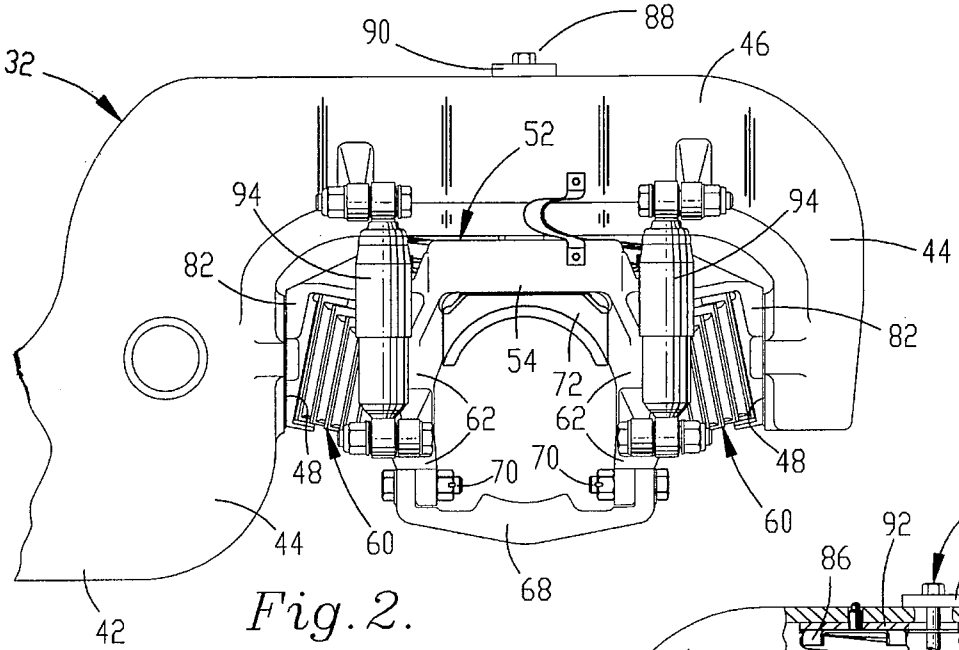
FIG. 2 is a fragmentary side elevational view of the railtruck, illustrating a suspension assembly forming a part of the railtruck.

The frame 32 includes two longitudinally extending side frame members 42 and at least one transom extending between and connecting the side frame members together. Each side frame member defines a pair of longitudinally spaced cradles, one at each end thereof. Preferably, as shown in FIG. 2, each cradle is C-shaped, and is defined by a pair of longitudinally spaced vertical frame portions 44 and an upper horizontal portion 46 connecting the vertical portions together. The vertical portions each present a vertical mounting surface 48 for receiving the primary suspension means, and the horizontal portion includes a top wall 50, as shown in FIG. 3, that is also adapted to support the primary suspension means, as described below. The cradles of each side frame member are aligned longitudinally with the cradles of the other side frame member so that the wheel and axle sets are supported in an orientation transverse to the longitudinal axis defined by the frame.

Figure 4:
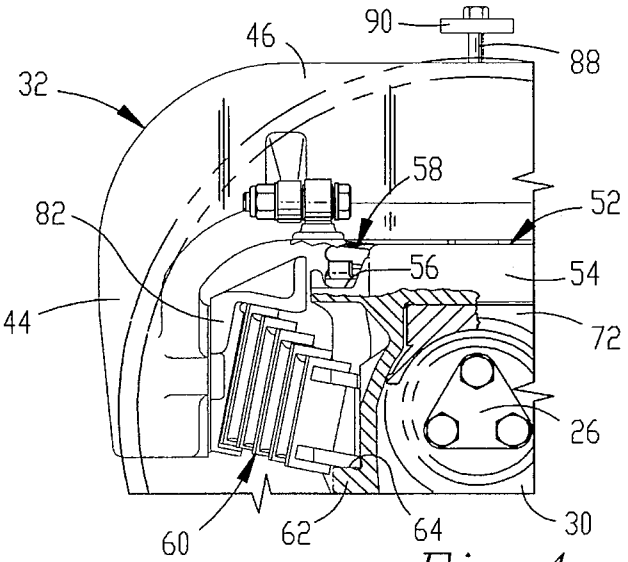
FIG. 4 is a fragmentary side elevational view of the railtruck, partially in section to illustrate features of a bearing housing forming a part of the suspension assembly.
Figure 5:
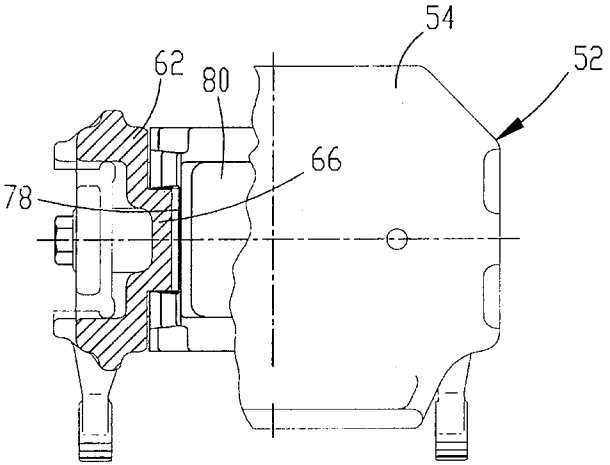
FIG. 5 is a top plan view of the bearing housing, partially in section to illustrate an adapter forming a part of the suspension assembly.

Four bearing housings 52 are provided in connection with each railtruck frame. Each bearing housing is received in one of the cradles of the frame and is of a C-shaped construction corresponding to but smaller than the cradle. Each bearing housing presents a top wall 54 having an upper surface 56 adapted to support a pair of coil spring sets 58 forming a part of the primary suspension means, and a pair of longitudinally spaced side walls 62 depending from the top wall and defining seats 64, shown in FIG. 4, for supporting a pair of elastomeric springs 60 also forming a part of the primary suspension means. The seats 64 each include a horizontal portion and a vertical portion, both of which receive one of the elastomeric springs for transmitting longitudinal, lateral and vertical loads from the spring to the housing. The side walls 62 present interior surfaces that oppose one another, and each surface includes a protruding guide 66, as shown in FIG. 5, that extends vertically along the surface for guiding relative vertical movement of a wheel and axle set supported by the railtruck.

Returning to FIG. 2, the bottom of each housing 52 is open and is sized for receipt over one of the journal bearings. A bottom cap 68 is provided for each bearing housing for closing off the open bottom of the housing upon assembly of a wheel and axle set on the railtruck. Each bottom cap includes a horizontal wall and a pair of longitudinally spaced upstanding arms. Longitudinally extending holes are provided in the arms and in the side walls 62 of the bearing housing for receiving conventional fasteners 70. Thus, it is possible to remove the bottom cap from the housing by removing the fasteners.

Figure 6:
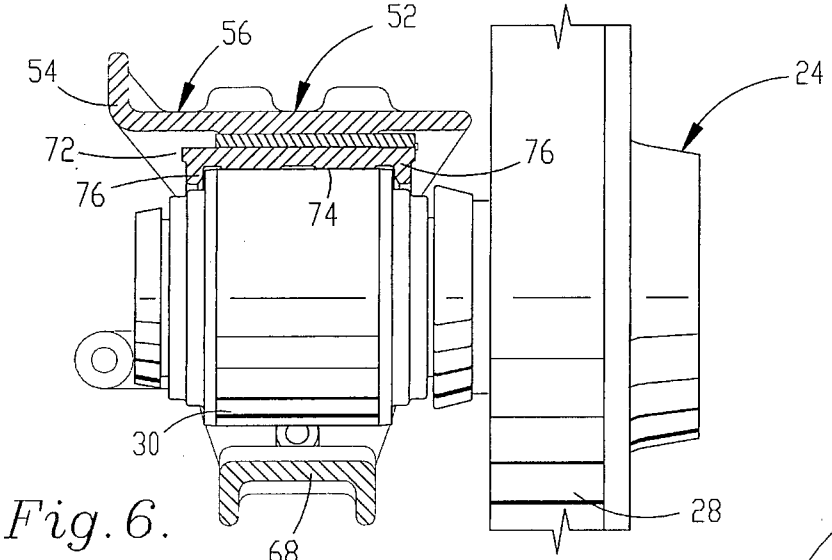
FIG. 6 is a sectional view of the bearing housing, illustrating a wheel and axle set supporting the housing.

A bearing adapter 72 is provided with each bearing housing 52 for supporting the housing on the journal bearing for relative vertical movement. As shown in FIG. 6, each adapter is formed of a single piece of material, and presents an arcuate lower surface 74 of a diameter corresponding to the diameter of the journal bearing so that the adapter rests on the bearing upon assembly. A pair of laterally spaced, depending flanges 76 protrude from the bottom surface 74 on either lateral side of the bearing so that the adapter is retained on the bearing and restricts lateral displacement of the wheel and axle set relative to the bearing housing. As shown in FIG. 5, the longitudinal ends of each adapter include centrally located vertical channels 78 adapted to ride along the guides 66 formed on the interior surfaces of the housing side walls. Thus, the adapter is guided for vertical movement within the housing and relative lateral movement is restricted. An upper surface 80 is also provided on each bearing adapter for engaging the underside of the top wall 54 of the bearing housing so that a load transmitted to the bearing housing is, in turn, transmitted to the wheel and axle set through the adapter.

Returning to FIG. 3, the primary suspension means at each bearing housing includes an independent primary suspension assembly made up of the pair of elastomeric springs 60 positioned between the side walls 62 of each bearing housing and the frame for supporting the frame on the bearing housing, and the pair of coil spring sets 58 positioned between the top wall 54 of the bearing housing and the frame. The elastomeric springs 60 are of conventional construction, each including a plurality of elastomeric pieces that are sandwiched between thin metal plates. The elastomeric pieces and the thin metal plates of each spring are all chevron-shaped, and are stacked together in the same orientation as one another. In the embodiment illustrated in the figures, the concave surfaces of the elastomeric pieces and the metal plates of each spring face longitudinally away from the bearing housing. However, other constructions are also suitable.

Each elastomeric spring 60 is received in one of the seats defined by the side walls 62 of the housing, and bears against the seat to transmit load to the housing. A spring adapter 82 is fastened to each vertical mounting surface 48 of the frame and includes a mounting surface 84 that bears against the frame and a longitudinally opposed seat against which the elastomeric spring bears. The seat has a central ridge to receive the concavity in the elastomeric spring, and is inclined at an angle relative to the mounting surface so that the elastomeric spring extends at an angle between the adapter 82 and the bearing housing 52. Each spring adapter 82 further includes a top wall that extends outward from the seat to support the elastomeric spring relative to the frame.

The coil spring sets 58 are positioned between the top wall 54 of each bearing housing and the frame 32, and each set includes a partially compressed nested pair of coil springs, wherein one of the springs is of a diameter small enough to fit within the coil formed by the other. The two spring sets are off-set from one another longitudinally on opposite sides of a central vertical axis dividing the bearing housing in half so that loads transmitted by the spring sets are exerted symmetrically on the bearing housing. Retention plates 86 are provided on the tops and bottoms of each spring set for positioning the set and for retaining the set in place. Fabreeka pads 92 are preferably provided between the upper retention plates and the top wall 50 of the frame.

Although it is not necessary to employ the coil spring sets in combination with the elastomeric springs, several advantages are obtained through the use of such a combination. For example, the elastomeric springs provide tri-axial stiffness in the vertical, lateral, and longitudinal axes, but the stiffness characteristics along these axes are not independently variable within a given elastomeric spring design. Reducing the static load capacity requirement allows the vertical stiffness to be reduced, but the lateral and longitudinal stiffness is reduced proportionally. Thus, it is not possible to affect a reduction of, for instance, just the longitudinal stiffness without affecting the other two stiffnesses. The use of the coil spring sets allows predetermining the load share which the elastomeric springs need to carry. Anywhere from perhaps 95% to 5% could be carried by the coils, leaving the elastomeric springs to carry from 5% to 95% as deemed desirable. With the vertical load share of the elastomeric springs independently variable of overall primary vertical stiffness, both the lateral and longitudinal stiffnesses also become independently variable of the overall primary suspension vertical stiffness.

In addition, the coil spring sets increase the load range over which the suspension is adaptable. The spring rates of the coil springs or the elastomeric springs can increase or decrease individually or together, to accommodate higher or lower loads. The coil spring sets allow using the same elastomeric spring design over a wider range of load requirements. Coil spring capacity can be changed more readily than the elastomeric spring capacity. This, for instance, allows using the same elastomeric spring under one railcar as is used under a different railcar that would not normally be capable of operating with the same elastomeric spring absent the use of coil springs.

Another advantage of combining the coil spring sets with the elastomeric springs is that the coil springs add longevity to the elastomeric springs. Fatigue in elastomers is more complex than just considering the strain range as for metallic parts. All rubber or synthetic is sensitive to work or the total work done on it over a period of time because a certain percentage of that work is retained in the part as residual heat which accelerates aging. Work has the units of force times distance (foot pounds). Reducing the load carried on the elastomeric springs by, e.g. 50% but at the same time maintaining the strain range constant throughout its cycles, has the resulting effect of reducing the work done by 50%. By carrying a portion of the load, the coil spring sets, themselves having long life, will increase the life of the elastomeric springs by reducing the amount of work the elastomeric springs must do. This has the overall effect of increasing the life of the complete primary suspension. In the current design, the coils would carry about 50% of the static load leaving 50% for the elastomeric springs.

An upstop bar 88 is secured to the top wall of each bearing housing and protrudes upward through a hole in the top wall 50 of the frame 32. A flange 90 is secured to the upstop bar at the upper end above the frame and bears against the top wall 50 when the bearing housing is lowered a predetermined distance relative to the frame. Thus, the upstop bar defines a retention means for retaining the bearing housing on the frame, and for retaining the primary suspension means in position between the frame and the bearing housing, when the frame is raised relative to the bearing housing. Preferably, the length of the upstop bar, or the position of the flange on the bar, is adjustable to adjust the amount of relative vertical movement between the bearing housing and the frame, and the flange can be unfastened to permit the bearing housing to be removed from the frame. By providing this construction, the upstop bar supports the bearing housing relative to the frame, and the bearing housing retains the elastomeric springs 60 and coil spring sets 58 in place between the housing and the frame, enabling replacement of the wheel and axle set without requiring complete disassembly of the primary suspension assembly at each end of the wheel and axle set. The bearing adapter 72 slides out of the housing along with the wheel and axle set upon relative lifting of the frame. As shown in FIG. 2, a pair of dampers 94 can be secured between the frame and each bearing housing for damping vibration caused during high speed travel. These dampers would not require removal for wheel and axle set replacement.

One of the primary suspension assemblies is shown in FIG. 3 as it would be assembled and shipped from the manufacturer. The coil spring sets 58 are partially compressed by the threaded upstop bar 88 so that the elastomeric springs 60 and the bearing housing is semi-solid with the frame. By unfastening the bottom cap, the assembly is easily made ready to be lowered onto a wheel and axle set. The bearing adapter 72 is shipped loose and is set on the journal bearing prior to lowering the frame onto the wheel and axle set. When the frame is lowered onto the set, the adapter 72 is received in the housing, and the bottom cap 68 is secured in place to retain the set in the housing. Thereafter, by removing the bottom cap it is possible to remove the wheel and axle set simply by jacking the frame relative to the set.

There are several locations on the apparatus where shims may be positioned to compensate for machining variations and for wear that is experienced during use of the apparatus. For example, with reference to FIG. 3, it is possible to place one or more shims between the top wall 54 of each bearing housing and the bottom retention plate 86 to correct the coil spring load height of the spring sets. In order to compensate for wheel wear, shims can be inserted between the top of the adapter 72 and the top wall of the bearing housing, as shown in FIG. 6. This is accomplished by placing a jack beneath the bottom cap 68 of the housing and lifting the housing so that the wheel and axle set 24 and the bearing adapter 72 drop relative to the housing, leaving a space between the adapter and the top wall.

Returning to FIG. 3, in order to compensate for machining tram variations, shims can be fastened between the spring adapters 82 and the frame by positioning the shims between the opposing mounting surfaces 48, 84 of the frame and the adapter. This is possible by using removable fasteners to secure the spring adapters 82 to the frame. It is possible to compensate for settlement of the elastomeric springs by placing shims between the bearing housing 52 and the elastomeric springs 60, either on the horizontal or vertical portions of the seats 64.

By constructing a railtruck apparatus in accordance with the embodiment illustrated in FIGS. 1–6, removal and replacement of wheel and axle sets is simplified, and it is possible to quickly and easily shim for machining variations, suspension settlement, and wheel tread wear.

As mentioned above, it is another object of the present invention to provide a railtruck having a construction that equalizes loads on all of the wheels on which the railtruck is supported during height change of any one of the wheels, in compliance with proposed performance requirements. A railtruck apparatus satisfying this object of the invention is illustrated in FIGS. 7–14, and the novel aspects of the apparatus can be employed either individually or in combination with any or all of the novel features described above with regard to the embodiment illustrated in FIGS. 1–6.

The railtruck apparatus is similar to the apparatus illustrated in FIGS. 1–6 in that it is particularly adapted for use with railcars for inner city, commuter service and/or intercity service such as Amtrak. Likewise, two railtrucks are provided for supporting the railcar, and each railtruck apparatus is supported on a pair of longitudinally-spaced wheel and axle sets.

Figure 7:
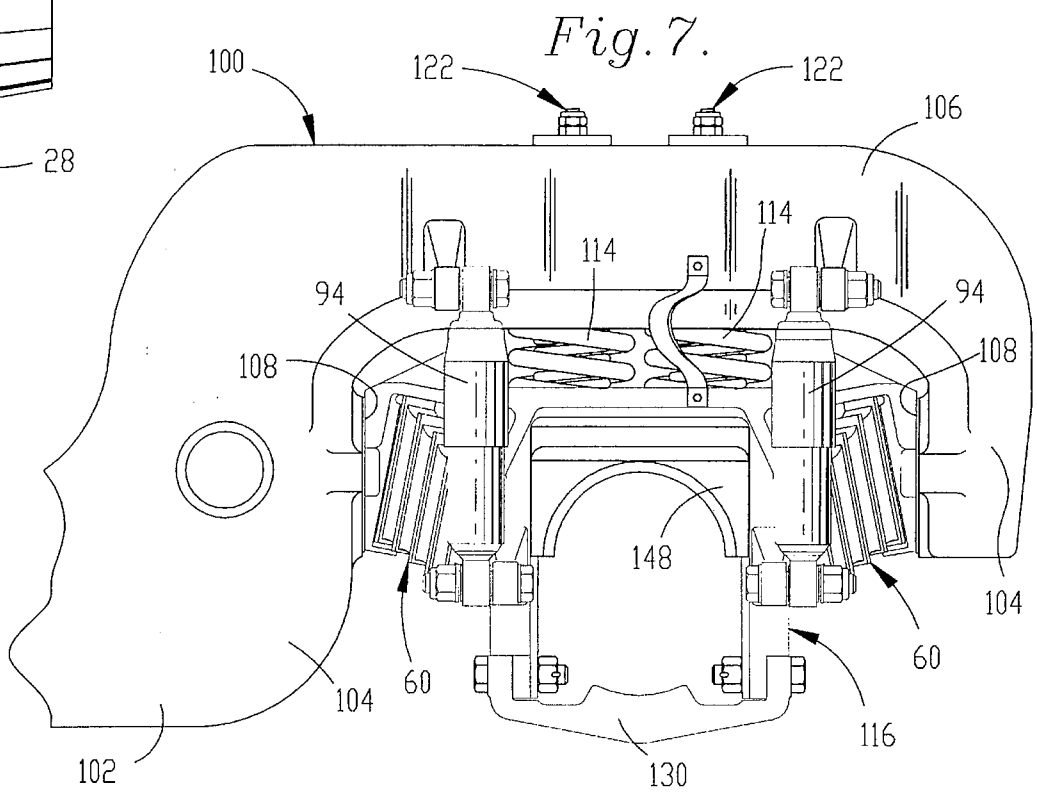
FIG. 7 is a fragmentary side elevational view of a railtruck constructed in accordance with a second embodiment of the invention.
Figure 8:
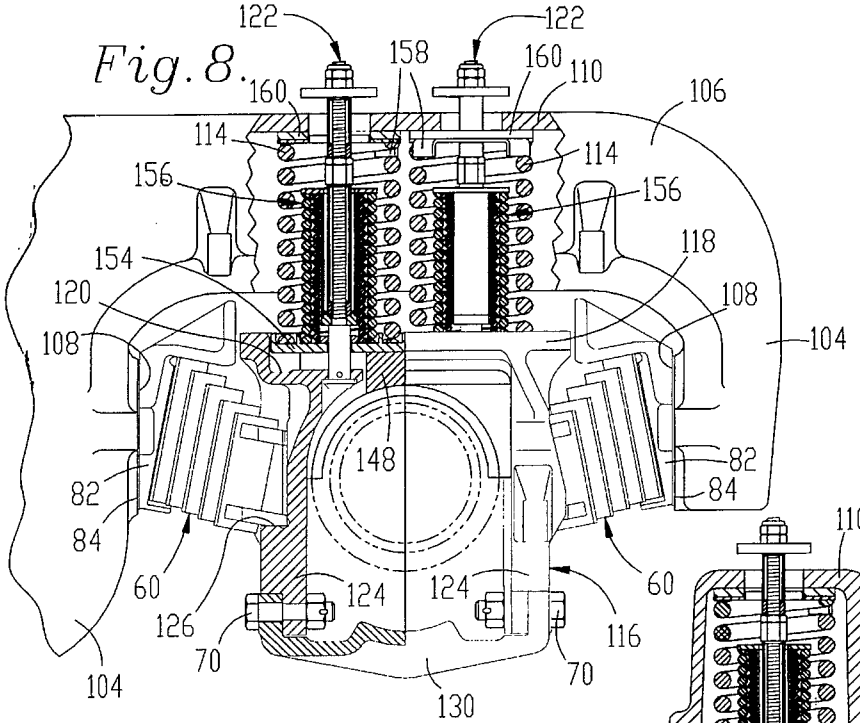
FIG. 8 is a fragmentary side elevational view of the railtruck of FIG. 7, partially cut away and sectioned to illustrate load-equalizing springs of the suspension assembly in a lightly loaded position.

With reference to FIG. 7, each railtruck generally includes an H-shaped frame 100, a bolster supported between the frame and the railcar as described above, and primary suspension means for supporting the frame on a pair of the wheel and axle sets. The frame includes two longitudinally extending side frame members 102 and a transom extending between and connecting the side frame members together. Each side frame member defines a pair of longitudinally spaced cradles, one at each end thereof. Preferably, each cradle is C-shaped, and is defined by a pair of longitudinally spaced vertical frame portions 104 and an upper horizontal portion 106 connecting the vertical portions together. As illustrated in FIG. 8, the vertical portions each present a mounting surface 108 for receiving a pair of elastomeric springs 60 forming a part of the primary suspension means, and the horizontal portion includes a top wall 110 that is adapted to support a pair of primary coil springs 114 also forming a part of the primary suspension means. The cradles of each side frame member are aligned longitudinally with the cradles of the other side frame member so that the wheel and axle sets are supported in an orientation transverse to the longitudinal axis defined by the frame.

Figure 9:
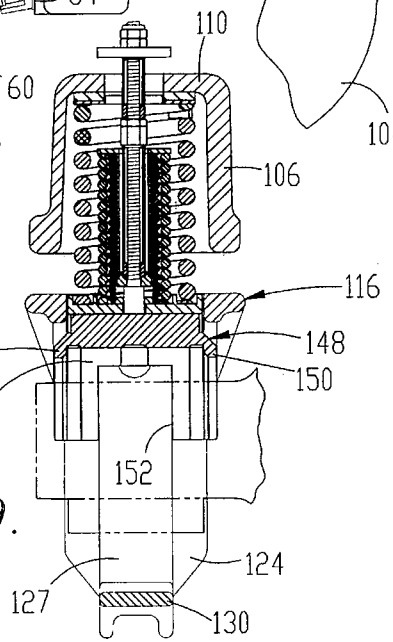
FIG. 9 is a sectional view of the railtruck of FIG. 7, illustrating the load-equalizing springs in the same lightly loaded position as shown in FIG. 8.

Four bearing housings 116 are provided in connection with each railtruck frame. Each bearing housing is received in one of the cradles of the frame and is of a C-shaped construction corresponding to but smaller than the cradle. Each bearing housing presents an open top wall 118 having a recessed upper surface 120 adapted to receive the primary coil springs 114 and a load-equalizing spring means for supporting the bearing housing on one of the journal bearings. The top wall 118 includes a pair of longitudinally spaced, vertically extending holes adapted to receive upstanding suspension rod assemblies 122. Each bearing housing also includes a pair of longitudinally spaced side walls 124 depending from the top wall and defining seats 126 for supporting the elastomeric springs 60. Each seat includes horizontal and vertical portions that support one of the elastomeric springs so that longitudinal, lateral and vertical loads are transmitted to the housing by the elastomeric springs. As shown in FIG. 9, the side walls 124 present interior surfaces that are opposed to one another, and each surface includes a protruding guide 127 that extends vertically along the surface for guiding relative vertical movement of a wheel and axle set supported by the railtruck.

Preferably, the bottom of each housing 116 is open and is sized for receipt over one of the journal bearings of one of the wheel and axle sets. A bottom cap 130 is provided for each bearing housing for closing off the open bottom of the housing upon assembly of the railtruck and wheel and axle sets. Each bottom cap includes a horizontal wall and a pair of longitudinally spaced upstanding arms. Longitudinally extending holes are provided in the arms and in the side walls of the bearing housing for receiving conventional fasteners 70.

Figure 12:
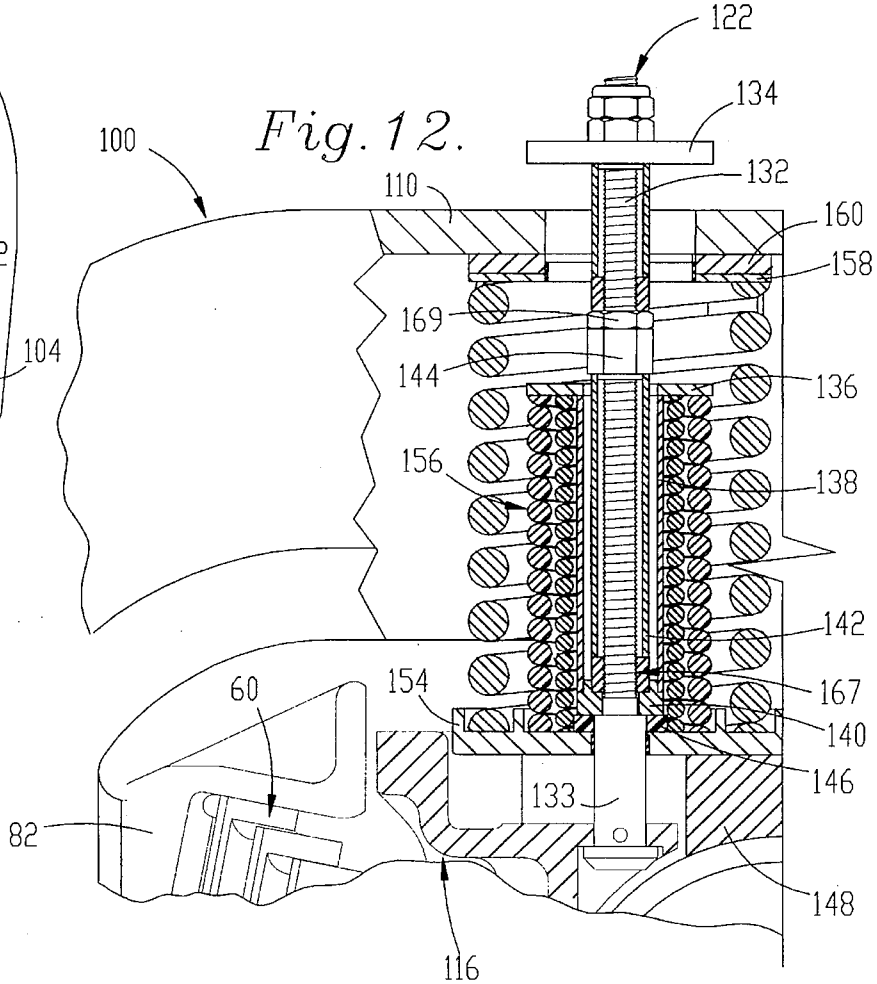
FIG. 12 is a fragmentary side elevational view of the railtruck of FIG. 7 from inside of the railtruck, partially cut away and sectioned to illustrate the suspension assembly in a normally loaded position.

With reference to FIG. 12, each suspension rod assembly 122 includes a threaded rod 132 that extends between the bearing housing and the frame, and includes a flange 134 that is secured to the upper end of the rod above the frame and bears against the top wall 110 of the frame when the bearing housing is lowered a predetermined distance relative to the frame. Thus, the suspension rod assembly 122 defines a retention means for retaining the bearing housing on the frame, and for retaining the primary suspension means in position between the frame and the bearing housing, when the frame is raised relative to the bearing housing. Preferably, the position of the flange along the length of the threaded rod is adjustable to adjust the amount of relative vertical movement between the bearing housing and the frame, and the flange 134 can be unfastened to permit the bearing housing to be removed from the frame. As shown in FIG. 7, a pair of dampers 94 can be secured between the frame and each bearing housing for damping vibration caused during high speed travel.

An annular spring retainer 136 is also provided on each suspension rod assembly, and is secured to the threaded rod at a fixed height that is adjustable. Preferably, the spring retainer 136 is affixed to the upper end of an outer tubular element 138 that is received over the threaded rod. The outer tubular element includes an end piece 140 at the bottom end thereof that is held axially against a large-diameter end portion of the threaded rod by an inner tubular assembly 142 that is received within the outer tubular element 138. The inner tubular assembly includes a hex-shaped wrench pad 144 and a threaded end piece 167 which secures the inner element on the threaded rod, allowing the suspension rod assembly to be assembled and disassembled. The end piece 140 of the outer tubular element 138 is of a larger diameter than the large-diameter end portion 133 of the threaded rod, and defines a shoulder that extends circumferentially around the rod.

Figure 13:
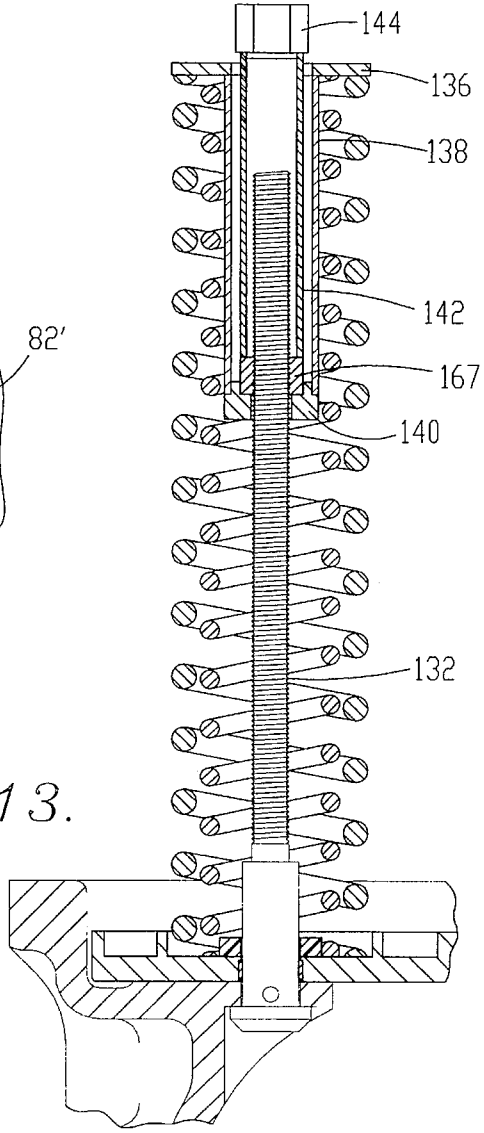
FIG. 13 is a fragmentary side sectional view of the railtruck of FIG. 7 from inside of the railtruck, illustrating the assembly sequence of the load equalizing springs.

Assembly of the spring retainer on the threaded rod 132 of each suspension rod assembly is shown in FIG. 13. The retainer 136, outer tubular element 138, and inner tubular assembly are received over the rod 132 and threaded to the desired position. Thereafter, as shown in FIG. 12, a lock nut 169 is used to secure the spring retainer in place prior to assembly of the flange 134 on the upper end of the rod.

Returning to FIG. 8, a bearing adapter 148 is provided on each bearing housing for supporting the bearing housing on the journal bearing 30 for relative vertical movement. As shown in FIG. 9, each adapter is formed of a single piece of material, and presents an arcuate lower surface 149 of a diameter corresponding to the diameter of the bearing so that the adapter rests on the bearing upon assembly. A pair of laterally spaced, depending flanges 150 protrude from the bottom surface on either side of the bearing so that the adapter is retained on the bearing and restricts lateral displacement of the wheel and axle set relative to the bearing housing. The longitudinal ends of each adapter include centrally located vertical channels 152 adapted to ride along the guides formed on the interior surfaces of the housing side walls. Thus, the adapter is guided for vertical movement within the housing and relative lateral movement is restricted.

Returning to FIG. 8, an upper portion of each adapter 148 protrudes above the upper surface 120 of the bearing housing into the recess defined by the open top wall 118 for engaging the load-equalizing spring means and the primary coil springs 114 so that a load transmitted to the bearing housing is, in turn, transmitted to the wheel and axle set through the adapter. A support plate 154 is preferably provided between the adapter 148 and the load-equalizing spring means and primary coil spring means for transmitting loads to the adapter. The support plate 154 includes a lower surface that is engaged by the adapter and an upper surface on which the load-equalizing spring means and primary coil springs are supported. With reference to FIG. 12, an annular pad 146 of elastomeric material is provided on the support plate around each threaded rod of each suspension rod assembly 122, and the shoulders of the outer tubular elements 138 of the assemblies engages these pads during normal loading of the apparatus to transmit loads exerted on the bearing housing through the support plate to a bearing adapter.

Returning again to FIG. 8, each primary suspension means includes the pair of elastomeric springs 60 positioned between the side walls 124 of each bearing housing and the frame for supporting the frame on the bearing housing, and also includes the pair of primary coil springs 114 positioned between the support plate and the frame.

Each elastomeric spring is received in the seat 126 of one of the side walls of the housing, and bears against the seat to transmit load to the housing. A spring adapter 82 is fastened to each vertical mounting surface of the frame and includes a mounting surface 84 that bears against the frame and a longitudinally opposed seat against which the elastomeric spring bears. The seat of the adapter has a central ridge to receive the concavity in the elastomeric spring, and is inclined at an angle relative to the mounting surface so that the elastomeric spring extends at an angle between the adapter and the bearing housing. Each spring adapter 82 further includes a top wall that extends away from the seat to support the elastomeric spring relative to the frame.

The coil springs 114 are positioned between the support plate 154 and the frame, and are off-set from one another longitudinally on opposite sides of a central vertical axis dividing the bearing housing in half so that loads transmitted by the springs are exerted symmetrically on the bearing housing. Although it is not necessary to employ the coil springs in combination with the elastomeric springs, several advantages are obtained through the use of such a combination, as described above with reference to the embodiment illustrated in FIGS. 1-6. Retention plates 158 are provided on the tops of each spring set for positioning the set and for retaining the set in place. Fabreeka pads 160 are preferably provided between the upper retention plates and the top wall 110 of the frame.

The load-equalizing spring means is operatively interposed between the bearing housing 116 and the journal bearing along the path of transmission of loads so that when the journal bearing is lowered in the bearing housing, the load exerted on the journal by the frame is transmitted through the elastomeric springs and the load-equalizing spring means, acting in series with one another. The load-equalizing spring means associated with each bearing housing includes a pair of nested coil spring sets 156, each received on one of the suspension rod assemblies 122, as shown in FIG. 12, between the spring retainer 136 and the support plate 154. The springs of each set 156 are smaller than the primary coil springs 114 and are received within the primary coil springs so that no additional space is required to accommodate the load-equalizing spring means.

From the foregoing description, it is evident that the apparatus illustrated in FIGS. 7–14 is capable of permitting the removal and replacement of wheel and axle sets, and allowing quick, relatively easy shimming for machining variations, suspension settlement, and wheel tread wear. These operations are carried out in the same manner as described above with respect to the embodiment illustrated in FIGS. 1–6. However, in addition to the advantages discussed above, the embodiment of FIGS. 7–14 also provides a construction in which the load-equalizing spring means is operatively interposed between the primary suspension means and the journal bearing so that when the journal bearing is lowered, the load is maintained on the wheel. Thus the range of movement of the bearing journal that can occur while a load is maintained on the journal by the series combination of the elastomeric spring means and the load-equalizing means is increased relative to the embodiment of FIGS. 1–6.

During normal loading, e.g. when an empty or loaded railcar is supported at rest by a pair of railtrucks constructed in accordance with the embodiment of FIGS. 7–14, each spring set 156 of the load-equalizing spring means assumes the position illustrated in FIG. 12. The railcar can be designed to support a reasonably wide range of railcar weights since the type of railcar is different for each application and the weights do vary. For the sake of discussion, an empty railcar weight at rails of 122,500 pounds results in a corresponding load per wheel at rail of 122,500÷8=15,813 pounds. Deducting the unsprung weight of the wheel, axle, and axle mounting equipment gives a load on the primary suspension means of 13,100 pounds per journal. The primary coil springs 114 and the elastomeric springs 60 act in parallel to divide the load by whatever proportion is determined best. For example, if the primary coil springs carry 7,100 pounds empty car load, the load share carried by the pair of elastomeric springs is 13,100–7,100=6,000 pounds. A desirable stiffness of the coil spring pair 114 and the elastomeric spring pair 60 to carry this load has been determined to be 1,278 pounds per inch and 5,335 pounds per inch, respectively. Being in parallel, the total stiffness supporting the 13,100 pound load would be 5,335+1,278=6,613 pounds per inch per journal suspension.

The load paths of the primary suspension means as shown in FIG. 12 are as follows. The load transmitted through the primary coil springs 114 follows the path through the fabreeka pads 160, the spring retention plates 158, the primary coil springs 114, the coil spring support plate 154, and the bearing adapter 148 to the journal bearing. The load transmitted through the elastomeric springs 60 follows the path through the spring adapters 82, the elastomeric springs 60, the bearing housing 116, the suspension rod assemblies 122, the equalizer coil spring retainer 136, the equalizer coil spring sets 156 and force pads 146, the coil spring support plate 154, and the bearing adapter 148 to the journal bearing.

The load being carried by the elastomeric springs 60 in this example is 6,000 pounds or 3,000 pounds per elastomeric spring. The equalizer coil spring sets 156, in this example being under compression load maintained by the suspension rod assembly 122, carry 6,200 pounds total or 3,100 pounds per set. Thus, the load in each suspension rod assembly is 3,100 pounds. The weight of the bearing housing 116 is about 200 pounds which is also pulling down on the rod in addition to the elastomeric spring load. The equalizer spring sets pulling up on the housing with 6,200 pounds and the elastomeric springs pushing down with 6,000 pounds plus the 200 pound housing weight produces equilibrium of forces at the position shown. The force pads 146 would prevent the equalizer coils from being pulled into a higher compression load state but, in this example, are carrying zero or near zero load. At higher elastomeric spring loads as passengers board the railcar, the force pads pick up and transmit whatever increase in elastomeric spring load occurs.

Figure 10:
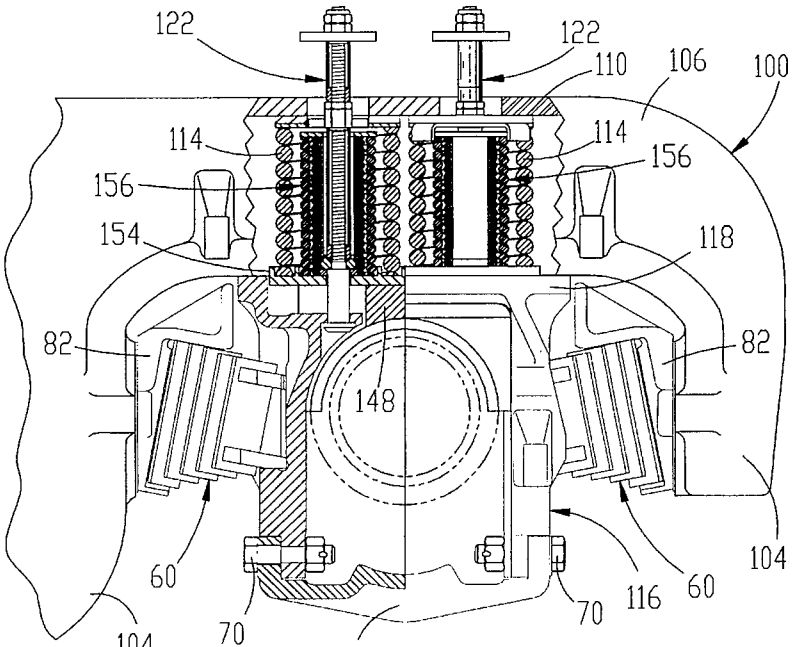
FIG. 10 is a fragmentary side elevational view of the railtruck of FIG. 7, partially cut away and sectioned to illustrate the suspension assembly in a heavily loaded position.

FIG. 10 illustrates the apparatus fully compressed to a position in which the top wall 118 of the bearing housing 116 bears against the frame 100 such that additional load is transmitted from the frame directly to the bearing housing rather than through the elastomeric springs 60 or the primary coil springs 114. Preferably, the solid stops engage prior to the primary coil springs going solid.

When the load on the elastomeric springs is reduced to less than 6,000 pounds, as would happen when a wheel rolls into a slight shallow, the load in the equalizer spring sets effects improved equalization. The condition which would occur with the wheel resting in a slight shallow is shown in FIGS. 8 and 9. The force in the equalizer coil spring sets 156 becomes higher than the force in the elastomeric springs 60 plus the housing weight, and pulls a clearance at the force pads 146 which restores force equilibrium. The force pads have a high stiffness and so, when they are in contact, the effective stiffness of the elastomeric spring pair is unaffected by the equalizer coil sets and remains 5,335 pounds per inch. Once a clearance is pulled at the force pads, the elastomeric springs 60 and equalizer coil sets 156 are effectively acting in series.

Two springs in series, each having different stiffnesses, will always result in the combined stiffness being less than the least stiffness of the two. A desirable stiffness of the two equalizer coils sets has been determined to be 568 pounds per inch for this example. The resulting stiffness of the elastomeric springs and equalizer coil sets in the series then is 513 pounds per inch. The 513 pounds per inch is the stiffness acting in parallel with the primary coil springs, giving a total stiffness per journal suspensions of 513+1,278=1,791 pounds per inch. The stiffness which would produce load lost from the suspension as the wheel drops has been reduced from 6,613 pounds per inch down to 1,791 pounds per inch, or a reduction of 73%. This is the effect which is sought with the embodiment illustrated in FIGS. 7–14.

Figure 11:
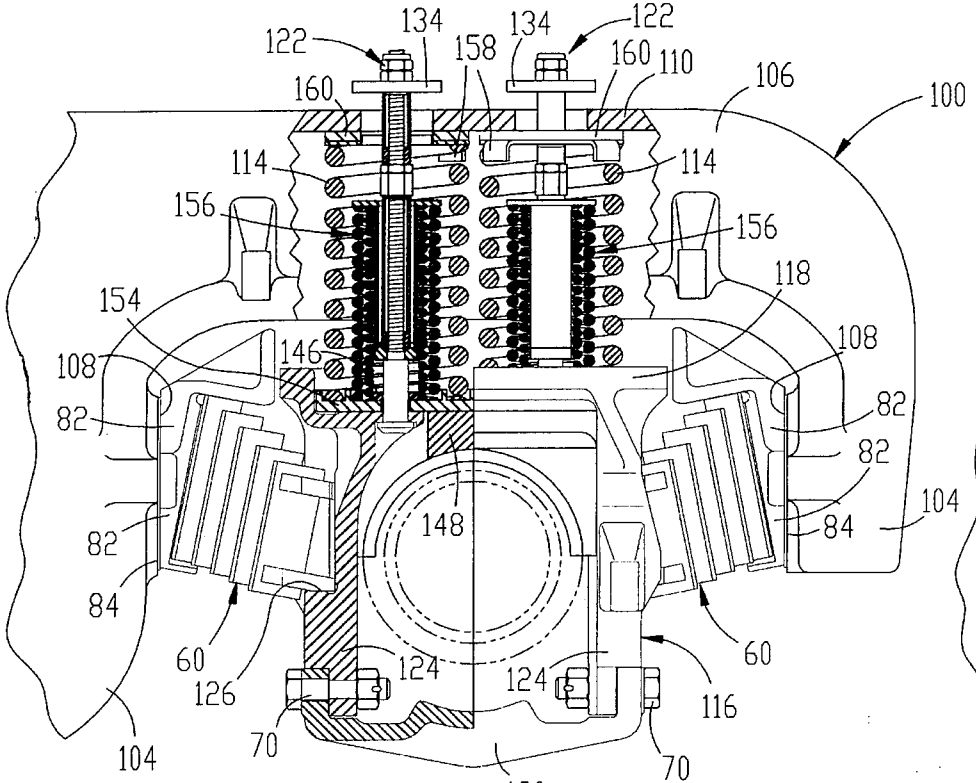
FIG. 11 is a fragmentary side elevational view of the railtruck of FIG. 7, partially cut away and sectioned to illustrate the load-equalizing springs in their maximum unloaded position.

As illustrated in FIG. 11, as the load continues to be removed from the railcar, the clearance at the force pads 146 is made greater and greater by the equalizer coil spring sets 156 until the coil spring support plate 154 contacts the recessed top wall 120 of the bearing housing 116. This represents the maximum available equalizing stroke of the equalizer coil spring sets. The elastomeric springs 60 remain loaded in this position and are not yet loose. However, the equalizer coil spring sets have extended as much as possible within the apparatus and no further equalization is provided. Preferably, this extreme position of the load equalizing spring means occurs only after a wheel has dropped by as much as about four inches relative to the other wheels.

Figure 14:
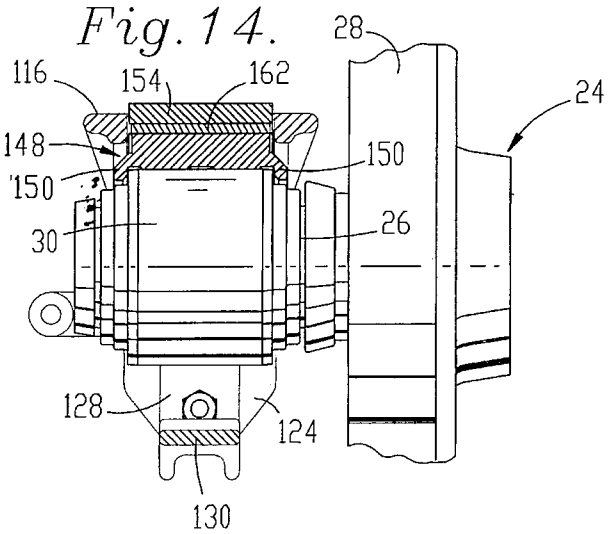
FIG. 14 is a sectional view of the bearing housing of the railtruck of FIG. 7, illustrating a wheel and axle set supporting the housing.

In FIG. 14, a shim 162 is illustrated as being positioned between the bearing adapter 148 and the coil spring support plate 154. By permitting such placement of a shim, it is possible to compensate for wheel wear. The shim raises all parts of the apparatus except the bearing adapter by an equal amount to compensate for the wheel wear.

Figure 16:
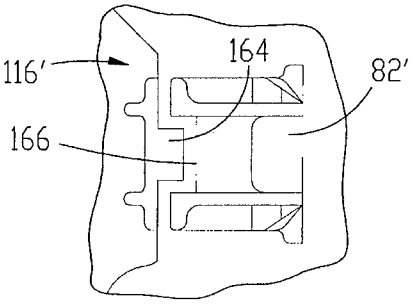
FIG. 16 is a fragmentary sectional view taken along the line 16—16 of FIG. 15.
Figure 15:
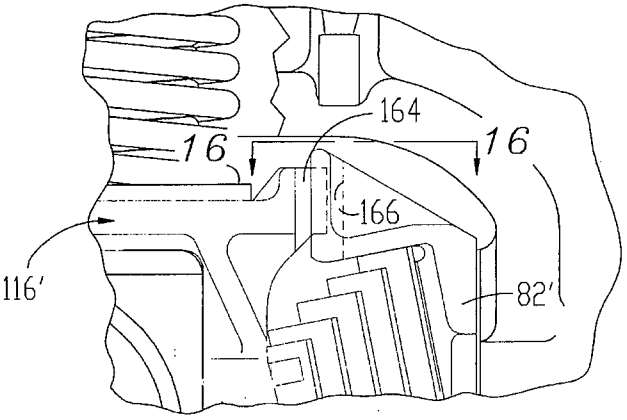
FIG. 15 is a fragmentary side elevational view of a railtruck constructed in accordance with a third embodiment of the invention.

An alternate construction of the apparatus is illustrated in FIGS. 15–16, wherein a means is provided for restricting lateral and longitudinal movement of the bearing housing 116' relative to the frame. As shown in FIG. 15, the bearing housing is provided with a stop element 164 that protrudes from each side wall at a position adjacent the top wall of the housing. Each stop element 164 extends vertically, and includes two parallel side surfaces and an end surface that is transverse to the side surfaces. Each spring adapter 82' is provided with a vertical movement-restricting channel 166 having a pair of parallel side surfaces and a bottom surface extending transverse to the side surfaces. The channels 166 are dimensioned larger than the stop elements 164 to define lateral and longitudinal clearances. Thus, as the bearing housing shifts vertically relative to the frame, lateral and longitudinal movement of the housing are restricted within the clearances provided between the stop elements and the movement-restricting channels. The amount of nominal clearance is variable by design, but in the exemplary embodiment is 0.50 inches. By providing such a construction, it is possible to mount additional equipment, such as brake or propulsion equipment, on the frame and axle without exceeding whatever motion limitation exists.

Although the present invention has been described with reference to the preferred embodiment, it is noted that equivalents may be employed and substitution made herein without departing from the scope of the invention as recited in the claims.

What is claimed is:

1. A railtruck apparatus for supporting a railcar body on two longitudinally spaced wheel and axle sets, wherein each wheel and axle set includes an axle presenting opposed ends, a pair of laterally spaced wheels secured to the axle, a pair of laterally spaced journals, and a pair of bearings supported on the journals, the apparatus comprising:

a frame including two longitudinally extending side frame members and a transom connecting the side frame members together, each side frame member defining a pair of longitudinally spaced cradles, the cradles of each side frame member being aligned longitudinally with the cradles of the other side frame member;

four bearing housings, each received in one of the cradles of the frame and including a top wall, two longitudinally spaced side walls depending from the top wall, and an open bottom having a predetermined size adapted for receipt over one of the journal bearings;

a bottom cap attached to each bearing housing between the side walls to close the open bottom upon assembly of the apparatus and the wheel and axle sets, the bottom caps being removable to permit the wheel and axle sets to be removed from the apparatus;

a primary suspension means positioned between each bearing housing and the frame for supporting the frame on the bearing housing; and a retention means for retaining each bearing housing on the frame, and for retaining the primary suspension means in position between the frame and the bearing housing, when the frame is raised relative to the bearing housing so that when the wheel and axle sets are removed from the apparatus, the bearing housings and the primary suspension means are retained on the frame.

2. A railtruck apparatus as recited in claim 1, further comprising an adapter received in each bearing housing adjacent the top wall, each bearing housing including a guide means for guiding vertical movement of the adapter toward and away from the top wall while restricting lateral movement of the adapter relative to the housing.

3. A railtruck apparatus as recited in claim 1, wherein the retention means includes a bar connected to each bearing housing and suspended from the frame so that the bearing housings are retained in position on the frame when the frame is raised relative to the bearing housings and the primary suspension means are retained on the frame.

4. A railtruck apparatus as recited in claim 1, wherein the primary suspension means includes a pair of springs positioned between each bearing housing and the frame for supporting the frame on the bearing housing, each side wall of each bearing housing presenting a horizontal seat against which one of the springs is received.

5. A railtruck apparatus as recited in claim 1, wherein the primary suspension means includes a pair of springs positioned between each bearing housing and the frame for supporting the frame on the bearing housing, the apparatus further comprising a spring adapter positioned between the frame and each spring of the primary suspension means, each spring adapter presenting a vertical mounting surface adjacent the frame and an inclined support surface against which one of the springs is received.

6. A railtruck apparatus as recited in claim 1, further comprising at least one damper connected between each bearing housing and the frame for damping relative vertical movement of the bearing housing.

7. A railtruck apparatus as recited in claim 1, wherein each primary suspension means includes a pair of elastomeric springs positioned between the side walls of each bearing housing and the frame for supporting the frame on the bearing housing and a set of coil springs positioned between the top wall of each bearing housing and the frame.

8. A railtruck apparatus for supporting a railcar body on two longitudinally spaced wheel and axle sets, wherein each wheel and axle set includes an axle presenting opposed ends, a pair of laterally spaced wheels secured to the axle, a pair of laterally spaced journals, and a pair of bearings supported on the journals, the apparatus comprising:

a frame including two longitudinally extending side frame members and a transom connecting the side frame members together, each side frame member defining a pair of longitudinally spaced cradles, the cradles of each side frame member being aligned longitudinally with the cradles of the other side frame member;

four bearing housings, each received in one of the cradles of the frame and including a top wall and two longitudinally spaced side walls depending from the top wall, each bearing housing having a central opening of predetermined size adapted for receiving one of the journal bearings and for accommodating relative vertical movement between the journal bearing and the bearing housing;

a primary suspension means positioned between each bearing housing and the frame for supporting the frame on the bearing housing; and a load-equalizing spring means for supporting each bearing housing on one of the journal bearings, the load-equalizing spring means being operatively interposed between the bearing housing and the journal bearing along the path of transmission of loads between the bearing housing and the journal bearing so that when the journal bearing is lowered in the bearing housing, the load exerted on the journal by the frame is transmitted through the primary suspension means and the load-equalizing spring means acting in series.

9. A railtruck apparatus as recited in claim 8, wherein each bearing housing presents an open bottom having a predetermined size adapted for receipt over one of the journal bearings, the apparatus further comprising:

a bottom cap attached to each bearing housing between the side walls to close the open bottom upon assembly of the apparatus and the wheel and axle sets, the bottom caps being removable to permit the wheel and axle sets to be removed from the apparatus; and a retention means for retaining each bearing housing on the frame, and for retaining the primary suspension means in position between the frame and the bearing housing, when the frame is raised relative to the bearing housing so that when the wheel and axle sets are removed from the apparatus, the bearing housings and the primary suspension means are retained on the frame.

10. A railtruck apparatus as recited in claim 8, further comprising a bearing adapter received in each bearing housing adjacent the top wall, each bearing housing including a guide means for guiding vertical movement of the bearing adapter toward and away from the top wall while restricting lateral movement of the bearing adapter relative to the housing, the load-equalization spring means being operatively interposed between the bearing housing and the bearing adapter.

11. A railtruck apparatus as recited in claim 9, wherein the retention means for each bearing housing includes at least one suspension rod coupled to the bearing housing and presenting an upper end that is suspended from the frame so that the bearing housing is retained in position on the frame when the frame is raised relative to the bearing housing and the primary suspension means and the load-equalizing spring means are retained on the frame.

12. A railtruck apparatus as recited in claim 8, wherein the primary suspension means includes a pair of springs positioned between each bearing housing and the frame for supporting the frame on the bearing housing, each side wall of each bearing housing presenting a horizontal seat against which one of the springs is received.

13. A railtruck apparatus as recited in claim 8, wherein the primary suspension means includes a pair of springs positioned between each bearing housing and the frame for supporting the frame on the bearing housing, the apparatus further comprising a spring adapter positioned between the frame and each spring of the primary suspension means, each spring adapter presenting a vertical mounting surface adjacent the frame and an inclined support surface against which one of the springs is received.

14. A railtruck apparatus as recited in claim 8, further comprising at least one damper connected between each bearing housing and the frame for damping relative vertical movement of the bearing housing.

15. A railtruck apparatus as recited in claim 8, wherein each primary suspension means includes a pair of elastomeric springs positioned between the side walls of each bearing housing and the frame for supporting the frame on the bearing housing, and a set of coil springs positioned between the top wall of each bearing housing and the frame.

16. A railtruck apparatus as recited in claim 10, further comprising at least one suspension rod attached to each bearing housing and presenting a spring retainer disposed above the bearing housing, the load-equalizing spring means for each bearing housing including a coil spring positioned between the spring retainer of the suspension rod and the bearing adapter for supporting the bearing housing on the bearing adapter so that when the bearing adapter is lowered in the bearing housing, the load exerted on the bearing adapter by the frame is transmitted through the primary suspension means and the load-equalizing spring means acting in series.

17. A railtruck apparatus as recited in claim 16, wherein the load-equalizing spring means includes a set of coil springs positioned between the spring retainer of the suspension rod and the bearing adapter.

18. A railtruck apparatus as recited in claim 8, further comprising a movement limiting means for guiding vertical movement of each bearing housing relative to the frame while limiting relative longitudinal and lateral movement.

* * * * *